US006595758B1

(12) United States Patent
Hauser et al.

(10) Patent No.: US 6,595,758 B1
(45) Date of Patent: Jul. 22, 2003

(54) METHOD FOR CONVEYING DAMP GASES BY MEANS OF A CONVEYOR DEVICE AND A CONVEYOR DEVICE FOR CARRYING OUT SAID METHOD

(75) Inventors: Erwin Hauser, Emmendingen (DE); Heinz Riedlinger, Freiburg (DE)

(73) Assignee: KNF Neuberger GmbH, Freiburg (DE)

( * ) Notice: Subject to any disclaimer, the term of this patent is extended or adjusted under 35 U.S.C. 154(b) by 0 days.

(21) Appl. No.: 09/831,443

(22) PCT Filed: Nov. 26, 1999

(86) PCT No.: PCT/EP99/08082

§ 371 (c)(1),
(2), (4) Date: May 9, 2001

(87) PCT Pub. No.: WO00/28212

PCT Pub. Date: May 18, 2000

(30) Foreign Application Priority Data

Nov. 10, 1998 (DE) ..... 198 51 680

(51) Int. Cl.[7] ..... F04B 19/24; F04B 39/00

(52) U.S. Cl. ..... 417/53; 417/439; 417/440; 417/435

(58) Field of Search ..... 417/53, 439, 440, 417/435

(56) References Cited

U.S. PATENT DOCUMENTS 2,812,893 A * 11/1957 Cotter ..... 417/307
5,174,735 A * 12/1992 Gannaway ..... 137/516.21
5,692,387 A * 12/1997 Alsenz et al. ..... 62/184

FOREIGN PATENT DOCUMENTS

DE 295 14 009 U * 11/1995
DE 296 18 911 U * 12/1996
JP 58015777 * 1/1983

* cited by examiner

*Primary Examiner*—Charles G. Freay
*Assistant Examiner*—Michael K. Gray
(74) *Attorney, Agent, or Firm*—Volpe and Koenig, P.C.

(57) ABSTRACT

The invention relates to a process for conveying damp gases by means of a conveyor device (1) and also relates to a conveyor device (1) for carrying out the process. The conveyor device (1) has at least one feed pump (2) with an oscillating reciprocating piston (3) in a delivery chamber (7). In order to dry the conveyor device (1) effectively in the region of the delivery chamber (7), the delivery chamber (7) of at least one feed pump (2) is intermittently ventilated at various intervals in time using an ventilation device (15) while the conveyor device (1) is in operation.

15 Claims, 2 Drawing Sheets

METHOD FOR CONVEYING DAMP GASES BY MEANS OF A CONVEYOR DEVICE AND A CONVEYOR DEVICE FOR CARRYING OUT SAID METHOD

BACKGROUND

The invention relates to a process for conveying damp gases by means of a conveyor device, which has at least one feed pump with an oscillating displacement piston in a delivery chamber. The invention also relates to a conveyor device, in particular for carrying out the process named at the beginning, with at least one feed pump with an oscillating displacement piston in a delivery chamber, and whose delivery chamber includes an intake with at least one suction valve and an outlet with at least one outlet valve, whereby at least one feed pump of the conveyor device has a ventilation device with a ventilation channel, that opens in an area of the delivery chamber and whereby a ventilation valve is connected intermediately in the ventilation channel, which can be activated as desired, independently of the stroke position of the piston.

From German patent publication DE 296 18 911 U1, it is known to provide a conveyor device of the previously mentioned type with a membrane pump, which conveyor device is, in particular, adapted for evacuation of an oven for the preparation of dentures or denture pieces. For trouble free running of this conveyor device to produce a vacuum, a ventilation valve is provided for the pump working chamber of the membrane pump of te conveyor device. This ventilation valve is connected behind the intake valve in the flow direction to the pump working chamber, so that the suction path of the membrane pump from the ventilation valve is free and the ventilation valve can have no influence on the flow through cross-section of the medium being pumped.

The ventilation valve for the conveyor device known from DE 296 18 911 U1 is intended alone to provide a low cost way, problem-free starting of the pump arrangement when a negative pressure exists in the suction line, and at the same time provide a high pumping performance with low costs. The conveyor device known from DE 296 18 911 U1, is however neither suitable for nor intended for use with damp gases, as required, for example in using an autoclave Medical instruments and other medical items of daily use are sterilized in autoclaves, which have a sterilization chamber that can be sealed so that it is airtight. Thereafter, the instruments located in the sterilization chamber are first exposed, prior to the sterilization operation, to a so-called fractionated pre-vacuum in which an especially good air removal is achieved even from narrow-orifice instruments, by repeated evacuation of the air in exchange with the periodic inflow of steam. During the sterilization operation, the instruments are exposed in the sterilization chamber to hot water vapor under high pressure. In order to dry the instruments quickly and without residue after sterilization, a so-called post-vacuum is in turn subsequently generated in the sterilization chamber. This post-vacuum should shorten the drying time of the sterilized product and optimize the drying operation.

For the evacuation, the sterilization chamber of these previously known vapor sterilization devices is connected to the conveyor device, which has a vacuum pump. Due to the impingement of the vacuum pump with water vapor, only water ring pumps or membranes have been used until now. Because of the structural dimensions and the disadvantages of a water ring pump, only membrane pumps are possible in the smaller vapor sterilization devices provided, for example, for the doctor's practice.

In the use of customary membrane gas pumps, however, there is the danger that liquid droplets occurring when conveying damp gases can lead to sticking of the gas valves and thus to the interruption of the evacuation process. Moreover, pockets that can hardly be avoided when boring out the flow channels in the cover plate of the pump head can also lead to an accumulation of liquid, whereby additional evacuation is made even more difficult.

In order to achieve a vaporization of the water droplets and to ensure an operation of the prior-art conveyor device that is as free from disruption as possible, the pump heads, especially in the membrane pumps used in vapor sterilization devices, are heated up to approximately 100° C. However, the vaporization of the liquid contained in the conveyor gas is associated with a considerable increase in volume of the conveyed medium, which leads to an increase in the evacuation time. Furthermore, hot pump heads act negatively on the lifetime of the membranes, valves, bearings and other structural parts that are used. These negative effects are amplified further by the already high ambient temperature, which results in the housings of these types of vapor sterilization devices due to the generation of vapor.

Such heads are relatively expensive, because in addition to these heating cartridges, a control device must also be constantly used with a temperature sensor to regulate the temperature of vaporization, and because these heating cartridges require for the most part at least as much electric power as the drive motor of the associated conveyor pump.

The objective of the invention is thus to create a process and a device of the above-named type, with which a simple conveyance of damp gases, which is free from disruption, is possible, without it being associated with an increased use of electrical energy and an increased wear of the feed pump used.

The objective of the invention is achieved in the process of the named type, in particular, in that the delivery chamber of at least one feed pump is ventilated one or more times at intervals during the operation of the conveyor device, as required and independently of the stroke position of the piston oscillating in the delivery chamber.

From U.S. Pat. No. 2,812,893, a device is already known that is constructed as a combination of a suction pump and a compressor. The prior-art device operates as a suction pump during the descending stroke of the piston, while it functions as a compressor during the ascending stroke. Therefore, the piston opens during the descending stroke at the valve openings provided on the cylinder circumference, so that under atmospheric pressure from the outside, additional air flows into the piston-displacement space and can be compressed in the subsequent ascending stroke because the air that is sucked in via the intake valve might not be sufficient by itself for compression.

The prior-art device from U.S. Pat. No. 2,812,893 has compression spring-loaded intake and outlet valves which open briefly at a defined pressure differential. If the outlet valve of the prior-art device opens, for example, at a pressure in excess of 10 bar, then the air quantity that is compressed during the ascending stroke and is over 10 bar is expelled via the outlet valve. Then, in the upper dead space, only the air quantity that is below this pressure limit remains. Since this harmful air volume still has a gas pressure of 10 bar, it would normally press the piston in such a way downwards, that the prior-art device can not assume the function of a suction pump during the descending stroke. The prior-art device thus has a ventilation valve in its pump head which is opened using an activation bar arranged on the piston in the top dead center position. The activation of the ventilation valve used in the prior-art device is thus done cyclically and as a function of the stroke position of the piston.

SUMMARY

In contrast, in the process according to the invention, the delivery chamber of at least one feed pump is ventilated one time or more times at time intervals as required and independently of the stroke position of the piston. In this manner, the liquid droplets that might stay in the delivery chamber are blown out from the conveyor device. The ventilation of the delivery chamber can be done during the operation of the feed pump at one time or more times at time intervals, for example, after certain condensation times or at different pressure levels in a chamber to be evacuated using the conveyor device. Since in the process according to the invention, a fast and targeted pump drying is done, the moisture contained in the conveyed medium can be condensed, the delivery chamber cooled and accordingly an energy-consuming heating up of the pump head can be omitted. In a further preferred embodiment according to the invention, the feed pump is cooled off in the area of its delivery chamber below the vaporization or boiling temperature present at the given evacuation pressure. By the cooling off of the damp conveyed medium, the volume of the original vaporous conveyed medium is also simultaneously reduced during the condensation to a fraction of the original volume. By this volume reduction in the area of the conveyor device, a condensation pump effect occurs, which determines or at least supports the conveying capacity of the conveyor device. Since the feed pump is cooled off below the vaporization or boiling temperature present at the given evacuation pressure, a revaporization of the conveyed medium that has already condensed is ruled out with certainty in the area of the feed pump. Since particularly in a vapor sterilization device, the water vapor contained in the conveyed medium is cooled and is conveyed in its liquid aggregate state, the feed pump has to pump only a low volume of the conveyed medium, whereby the required pump operating time is reduced considerably. The cooling of the feed pump required for cooling off the conveyed medium in the area of the delivery chamber simultaneously results in a cool running of the conveyor device, which promotes a long lifetime of the feed pump and long service intervals.

The ventilation of the delivery chamber in accordance with the present invention can also be done manually. However, in order to reduce costs and relieve the need for manual operation, the solution in accordance with the present inventive conveyor device which was not previously known provides, in particular, that the ventilation valve is in controlled connection with a control device, and that the control device has a time element and/or a pressure sensor for the one-time or multiple-time interval activation of the ventilation valve as a function of the condensation time and/or as a function of the pre-specified pressure levels in a chamber to be evacuated using the conveyor device.

In order to be able to blow out the liquid droplets that might possibly remain in the feed pump as much as possible from all areas of the delivery chamber, a preferred embodiment of the invention provides that the delivery chamber is connected with the suction valve via a suction channel and that the ventilation valve opens in the suction channel preferably directly in the area of the suction valve.

Provided the suction and/or outlet valves of the feed pump that has the ventilation device can be activated as is customary as a function of the pressure that is prevalent in the delivery chamber, the suction valve of the feed pump is abruptly closed when the ventilation valve is opened and when the delivery chamber of the suction valve is ventilated. The suction valve simultaneously acts as a return valve relative to the chamber to be evacuated of the conveyed medium. In this way it is achieved that upon the activation of the ventilation valve, a targeted flow is created in the feed pump with a sufficiently high flow speed in order to entrain the liquid droplets that have remained in the delivery chamber until now.

Since when the ventilation valve opens, the suction valve also simultaneously abruptly closes, the ventilation and/or drying gas can take only one direction and flow from the pump intake side directly through the delivery chamber to the pump outlet side. Through this measure, an effective pump drying is promoted.

In order to also be able to almost completely ventilate and dry a multi-stage conveyor device, it is advantageous if the feed pump that has the ventilation device forms the first pump stage of a multi-stage conveyor device.

In this process, it is advantageous if the pump stages of the conveyor device are connected via a flow channel whose channel cross-section is selected so that the flow force is greater than the adhesion force and especially so that an atmospheric volume flow of the conveyor device generates an average flow speed greater than 10 m/sec. This flow speed generates a frictional force on the border layer between the ventilation gas and the adhesive liquid that is greater than the adhesive force between the liquid and the flow surfaces provided in the delivery chamber. In this way it is ensured that the liquid droplets that stay in the delivery chamber detach from the flow surfaces of the delivery chamber and are entrained with the ventilation and/or drying gas.

The drying of the delivery chamber is additionally supported if the conveyor device has at least in certain areas, preferably at least in the area of the pump head of the feed pump(s), low-adhesion and especially non-metallic flow surfaces that have very low adhesive bonding forces to liquids. Here, it can be especially advantageous if the flow surfaces of the conveyor device have a plastic coating at least in a partial section, preferably a Teflon coating.

In order to make the accumulation of the smallest liquid droplets more difficult in the area of the delivery chamber, it is advantageous if the pump head of the feed pump(s) is constructed, at least in the area of a cover plate, as a diecast part preferably with a molded flow channel that is free of pocket holes. Since in this pump embodiment, the flow channels are molded into the pump head that is constructed as a diecast part, the pockets and pocket holes, in which the liquid could otherwise accumulate and which until now were not to be prevented when the flow channels were bored, are now prevented.

According to a further embodiment of the invention that has its own significance worthy of patent protection, it is provided that the pump head of the feed pump(s) is force-cooled and that preferably cooling ribs are provided on the outside for a forced-air cooling on the pump head of the feed pump(s). Since the pump head is force-cooled in this further-developed embodiment, the head temperature can also be cooled below the vaporization or boiling temperature present at the given evacuation pressure. In this further embodiment according to the invention, it is ensured that the water vapor contained in the conveyed medium can condense and can no longer re-vaporize. A re-vaporization of the condensate would namely result in an undesired volume increase of the conveyed medium as well as a corresponding lengthening of the required operating times of the conveyor device.

A preferred embodiment according to the invention provides that between the pump head and a crankcase of the feed pump(s), an intermediate cover or an intermediate plate is arranged in which the flow channels between the delivery chamber and the valves are provided and that the intermediate plate is constructed as a plastic part. Because of the ventilation valve provided according to the invention, a heating up of the pump head can also be prevented and since in the present object of the invention, a condensation of the liquid contained in the conveyed medium is promoted, the intermediate plate can, for example, be manufactured as an injection-molded part out of plastic. A plastic part of this type and in particular, a plastic injection-molded part, has a very smooth, water-repellent surface, whereby the adhesive effect can be reduced even further. Furthermore, the intermediate plate made of plastic forms a poor heat conductor, which forms an effective heat insulation between the hot pump head and the pump housing. Since the intermediate plate made out of plastic stays relatively cool in comparison to a pump head made from aluminum, for example, a condensation of the moisture contained in the conveyed medium and a rapid carrying away of the moisture droplets is encouraged in the area of the intermediate plate. Furthermore, an intermediate plate made out of plastic and in particular, as a plastic injection-molded part can be produced in a very cost-effective manner.

A preferred embodiment according to the invention provides that the feed pump(s) of the conveyor device, in particular the feed pump that has the ventilation device, is constructed as a reciprocating piston pump or preferably as a membrane pump.

Provided the conveyor device has a flow conduit with at least one pipe-shaped channel section, an optimization of the flow conductance can be achieved if this channel section is connected essentially without joints on the facing end to an adjacent partial area of the flow conduit using a sealing ring made of an elastic material. In this way, also in this area of the flow conduit, joints and other dead spaces are prevented in which the condensate could otherwise accumulate.

BRIEF DESCRIPTION OF THE DRAWINGS

Additional characteristics of the invention result from the following description of the preferred embodiments according to the invention in connection with the claims as well as the drawings. The individual characteristics can be made independently or together in an embodiment form according to the invention.

In the drawings.

DETAILED DESCRIPTION OF THE PREFERRED EMBODIMENT

Figure 1:
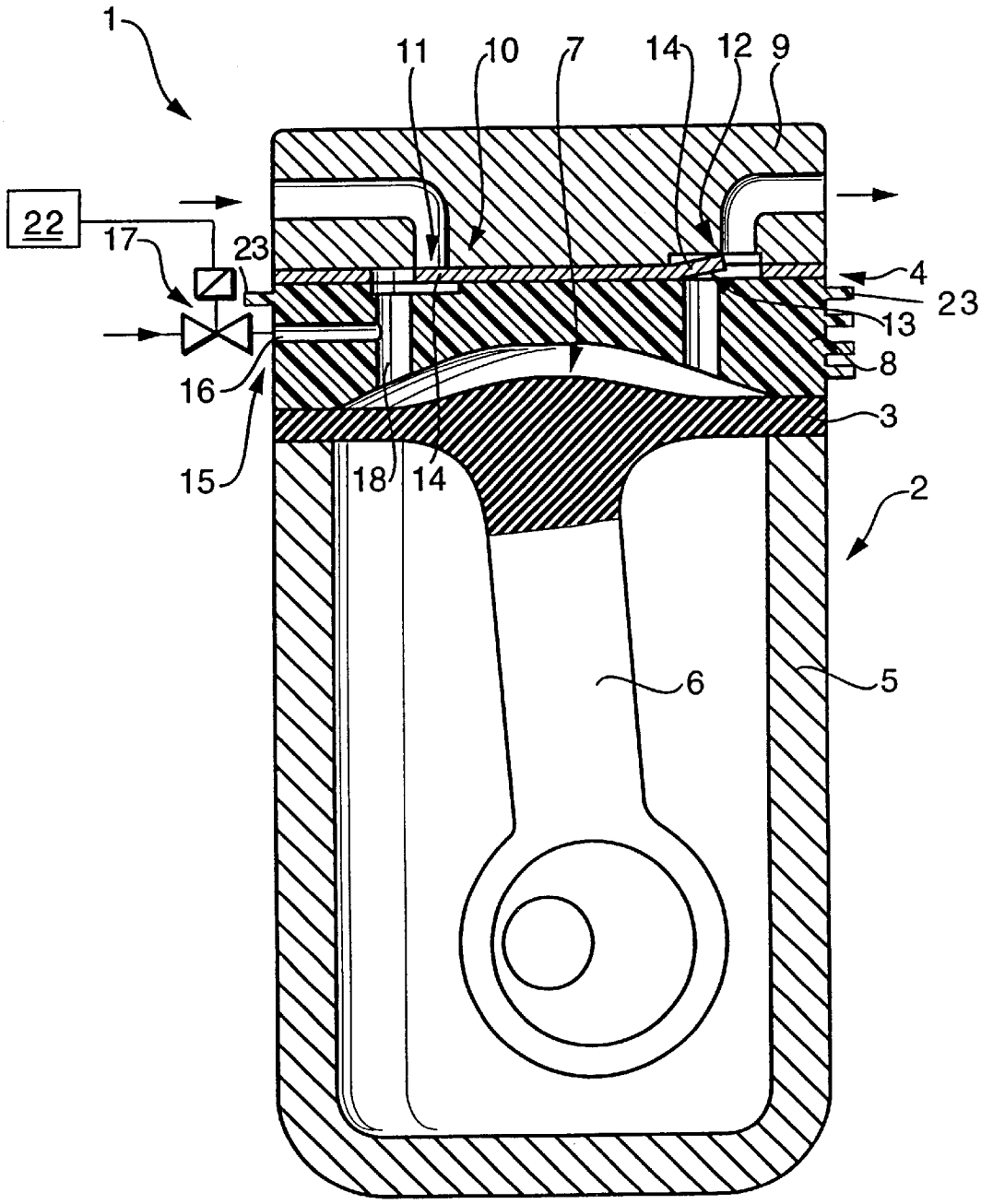
FIG. 1 is a cross-sectional view of a feed pump constructed as a membrane pump with a ventilation device whose ventilation channel opens in the area of the delivery chamber of the pump.

In FIG. 1, a feed pump is shown in a longitudinal section, which is constructed here as a membrane pump 2. The membrane pump 2 has a thin elastic molded membrane 3 that functions here as a piston, which is clamped at its perimeter affixed between a pump head 4 and a pump housing 5. The molded membrane 3 of the membrane pump 2, which is moved forward and backwards using a connecting rod 6, defines a delivery chamber 7 between it and the pump head 4.

The pump head 4 of the membrane pump 2 is constructed essentially in two-parts and has an intermediate plate 8 as well as a cover plate 9. In the pump head 4 of the membrane pump 2, an intake 10 with a suction valve 11 and an outlet 12 with an exhaust valve 13 are provided. The suction valve 11 and the exhaust valve 13 of the feed pump 2 can be activated depending on the pressure that is prevalent in the delivery chamber 7. The valves 11, 13 have in addition a valve body 14, which is constructed as a valve disc that is made out of elastomer. These valve discs can also be constructed, for example, in a tongue shape or round.

The membrane pump 2 is a component of an otherwise not further shown conveyor device 1, which functions for the conveyance of damp gases. These conveyor devices are, for example, used for the evacuation of vapor sterilization devices (so-called autoclaves) or in the field of gas drying.

In order to condense the moisture contained in the gaseous conveyed medium, to reduce the conveyed volume and to be able to keep as low as possible the time necessary, for example, to evacuate a vapor sterilization chamber, the pump head 4 of the feed pump 2 is force-cooled. The pump head 4 can have for this purpose a water cooling system, for example, whose cooling channels are very near and parallel to the gas flow channels arranged located in the pump head. In a preferred embodiment, however, the pump head 4 has in particular on its cover plate 9, in addition to or instead of a water cooling system, cooling ribs for a forced-air cooling that are not further depicted here.

Using this forced cooling, the feed pump 2 is force-cooled in such a way that it is cooled off in the area of its pump head below the existing vaporization or boiling temperature of the liquid contained in the gaseous conveyed medium, which corresponds to the evacuation pressure desired in the chamber to be evacuated. By the cooling off of the moist conveyed medium, the volume of the originally vaporous conveyed medium is simultaneously also reduced during condensation to a fraction of the original volume. Through this volume reduction in the head area of the conveyor device, a condensation pump effect occurs, which supports the conveying capacity of the conveyor device 1. Since the water vapor contained in the conveyed medium is cooled in the area of the feed pump 2 and conducted in its liquid aggregate state, the feed pump only has to pump off a low volume of the conveyed medium, whereby the required pump operating time is considerably reduced. The cooling system of the feed pump 2 required for cooling off the feed pump 2 in the area of the delivery chamber 7 simultaneously results in a cool running of the conveyor device 1, which promotes a long lifetime of the feed pump and long service intervals.

In order to prevent the suction valve 11 and the exhaust valve 13 from sticking due to the liquid droplets contained in the conveyed medium and in order to prevent an accumulation of liquid in possible dead spaces of the feed pump 2, which hinders a rapid evacuation, the delivery chamber 7 is ventilated in pulses at time intervals during the operation of the feed pump 2. In the process, the time intervals can be controlled depending on the pressure levels and/or condensation times reached in the (vapor sterilization) chamber to be evacuated.

The membrane pump 2 has, for this purpose, a ventilation device 15 with a ventilation channel 16, which opens in the area of the delivery chamber. In the ventilation channel 16, a ventilation valve 17 is intermediately connected, which is in constant controlled connection with a control device 22. In order to be able to activate the ventilation device 15 in specified or preselectable time intervals, the control device 22 has a control clock or equivalent time element. In addition to, or instead of this, the control device 22 can also be connected to pressure sensor located, for example, in the vapor-sterilization chamber of an autoclave, if the ventilation valve 17 should be activated as a function of the prespecified pressure levels in the chamber to be evacuated. Through the pulsating ventilation of the delivery chamber 7, the liquid droplets that might remain in the delivery chamber 7 are blown out of the conveyor device 1. The ventilation of the delivery chamber 7 can be done several times at time intervals during the operation of the feed pump 2, for example, according to certain condensation times or pressure levels. Since using the ventilation device 15, a fast and targeted pump drying is achieved, the liquid contained in the conveyed medium can be condensed, the delivery chamber can be cooled and accordingly, an energy-consuming heating up of the pump head 4 can be omitted.

As shown in FIG. 1, the delivery chamber 7 is connected to the suction valve 11 via a suction channel 18. In order to be able to blow out the delivery chamber as completely as possible, the ventilation chamber 16 of the ventilation device 15 opens in the flow direction of the pump intake 10 directly below the suction valve 11 in the suction channel 18.

During the ventilation of the delivery chamber 7, the suction valve 11 of the membrane pump 2 closes instantaneously. In this way, the ventilation or drying gas can take only one direction and flow from the pump intake side via the delivery chamber 7 to the pump outlet side. The activation of the ventilation device 15 makes it so that in the feed pump 2 a targeted flow is constructed with very high flow speed, which entrains the liquid droplets remaining in the delivery chamber 7. The liquid contained in the gaseous conveyed medium is conveyed in a defined manner out of the feed pump 2 after it condenses in the pump head 4 through a single or multiple cycling of the ventilation device 15. If the conveyor device 1 is used for example, to evacuate the vapor sterilization chamber of an autoclave or a vacuum drying cabinet, the evacuation time can be shortened considerably using the ventilation device 15 and the final vacuum can be improved.

The ventilation valve 17, which can also be constructed as a manually activated valve, is constructed here as an electromagnetic valve and integrated directly in the intermediate cover 8. This intermediate cover 8 is constructed as a plastic-injection molded part, which is characterized by a very smooth, liquid-repellent surface.

Since the intermediate cover 8 manufactured in a cost-effective manner out of plastic forms a very poor heat conductor, it can act as an effective heat insulation between the pump housing 5 and the cover plate 9. The liquid contained in the gaseous conveyed medium can condense well in the intermediate cover 8 that is cooler in comparison to the cooled cover plate 9.

In contrast, a more intensive heat exchange is desired in the area of the force-cooled cover plate 9, in order to quickly carry off the condensation heat that is released and to be able to cool the pump head. The cover plate 9 is thus preferably manufactured as a diecast part out of aluminum. In this aluminum diecast part, the gas flow channels provided for the conveyed medium are molded free of pocket holes. In this way, pockets and other dead spaces are for the most part prevented, which otherwise occur during the subsequent boring of these channels and in which the liquid can accumulate. In order to prevent an adhesion of the moisture in the pump intake and pump outlet, the pump head 4 also has non-metallic flow surfaces in the area of its cover plate 9. These flow surfaces are formed by a plastic coating, in particular, a Teflon coating, in the area of the cover plate 9 constructed as an aluminum diecast part.

Figure 2:
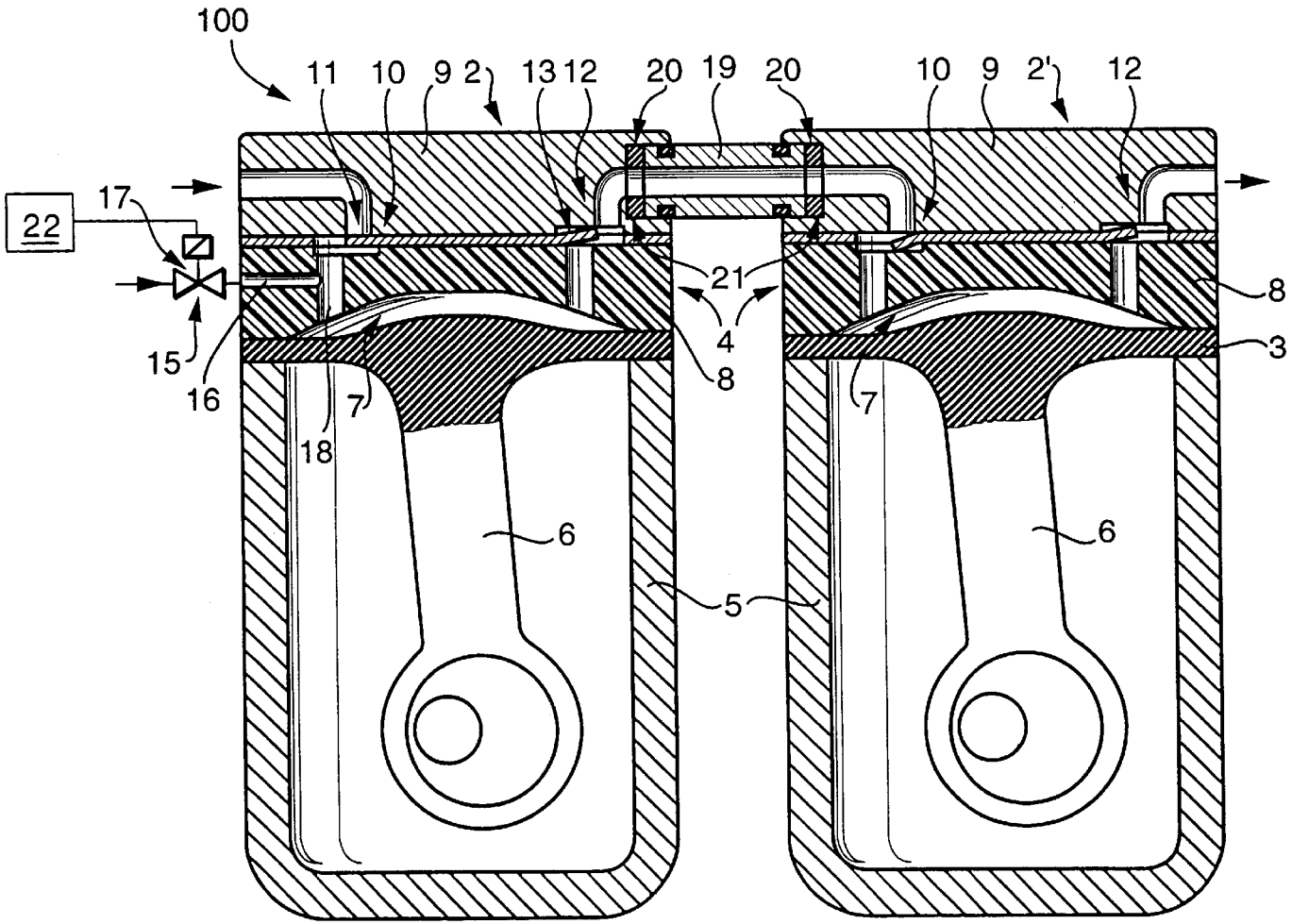
FIG. 2 is a cross-sectional view of two-stage conveyor device, which has two feed pumps, of which the first pump stage has a ventilation device in accordance with the invention.

As shown in FIG. 2, the feed pump 2 shown in FIG. 1 can also be part of a multi-stage conveyor device 100. In the two-stage conveyor device 100 formed from the membrane pumps 2, 2', the membrane pump 2 that has the ventilation device 15 is provided as the first pump stage, the pump outlet 12 of which is connected via a pipe-shaped channel section 19 to the pump intake 10 of the membrane pump 2'. This channel section 19 is held with its facing ends in connection openings 20 of the pumps 2, 2', whereby these facing ends of the channel section 19 are respectively connected to the adjacent partial area of the flow conduit via a sealing ring 21 without a joint and without a transition. Also, in the channel section 19 of the two-stage conveyor device 100, the channel cross-section of the flow channel is selected to be so small that an atmospheric volume flow of the feed pump 2 equipped with the ventilation device 15 generates an average flow speed greater than 10 m/sec.

In the conveyor devices 1, 100 shown here, the pump heads 4 of the feed pumps 2, 2' are cooled in such a way that the moisture contained in the gaseous conveyed medium can condense. The condensation is then achieved by a forced cooling system of the pump heads 4, which is constructed, for example as an air-cooling and/or water-cooling system. The pump head can also include cooling ribs 23, as shown in FIG. 1, for forced air cooling. By coated flow conduits optimized for flow, the condensate is transported into the conveyor devices 1, 100 in a manner free from adhesion. Through the condensation, a drastic reduction in volume occurs, whereby fast pump times and high pump efficiencies can be obtained. Using the ventilation device 15 provided in the feed pumps 2, a fast and targeted drying of the conveyor devices 1, 100 can be achieved, whereby a shortening of the evacuation time is favored even more and the final vacuum that can be achieved can be considerably reduced. Since the ventilation channel 16 of the ventilation device 15 opens in the delivery chamber 7 of the feed pump 2, the suction valve 11 operating depending on the pressure prevalent in the delivery chamber can simultaneously also act as a return valve, whereby a targeted drying of the conveyor devices 1, 100 can be achieved.

What is claimed is:

1. Process for conveying damp gases comprising providing a conveyor device (1, 100) which includes at least one feed pump (2, 2') with an oscillating reciprocating piston (3) in a delivery chamber (7), and ventilating the delivery chamber (7) of at least one of the at least one feed pump (2) one or more times at intervals during operation of the conveyor device (1, 100), independently of a stroke position of the piston.

2. Process according to claim 1, function comprising force-cooling the at least one feed pump (2, 2') in a pump head (4) area.

3. Process according to claim 2, wherein the at least one feed pump (2, 2') is cooled off in the pump head (4) area under the vaporization or boiling temperature present at a given evacuation pressure.

4. Conveyor device (1, 100) for conveying damp gases, comprising at least one feed pump (2, 2'), which includes an oscillating displacement piston (3) in a delivery chamber (7), where the delivery chamber (7) has an intake (10) with at least one suction valve (11) and an outlet (12) with at least one exhaust valve (13), at least one of the at least one feed pump (2, 2') has a ventilation device (15) with a ventilation channel (16), which opens in an area of the delivery chamber (7) and a ventilation valve (17) is connected intermediately in the ventilation channel (16), which can be activated as required to ventilate the delivery chamber (7) one or more times at intervals during operation of the conveyor device independently of a stroke position of the piston, and the ventilation valve (17) of the conveyor device for conveying damp gases is in controlled connection with a control device, and the control device has a time element and/or a pressure sensor for one-time or multiple-time interval activation of the ventilation valve as a function of a condensation time, and/or as a function of pre-specified pressure levels in a chamber to be evacuated with the conveyor device (1, 100).

5. Conveyor device according to claim 4, wherein the delivery chamber (7) is connected with the suction valve (11) via a suction channel (18) and the ventilation channel (16) opens in the suction channel preferably directly in an area of the suction valve (11).

6. Conveyor device according to claim 4, wherein the suction valves and/or the exhaust valves (11, 13) of at least the feed pump (2) that has the ventilation device (15) is activated depending on the pressure that is prevalent in the delivery chamber (7).

7. Conveyor device according to claim 4, wherein the feed pump (2) that has the ventilation device (15) forms a first pump stage of a multi-stage conveyor device (100).

8. Conveyor device according to claim 4, wherein the conveyor device (1, 100) includes flow channels in the at least one feed pump having a channel cross-section selected so that an atmospheric volume flow of the conveyor device (2) generates an average flow speed greater than 10 m/sec.

9. Conveyor device according to claim 4, wherein the conveyor device (1, 100) has non-metallic flow surfaces at least in an area of a pump head (4) of the feed pump (2, 2').

10. Conveyor device according to claim 4, wherein flow surfaces of the conveyor device (1, 100) have a plastic coating, at least in a partial section.

11. Conveyor device according to claim 4, wherein the feed pump (2, 2') includes a pump head (4) constructed, at least in the area of a cover plate (9), as a diecast part with molded flow channels that are free of pocket holes.

12. Conveyor device according to claim 4, wherein the pump head (4) of the feed pump(s) (2, 2') is force-cooled and cooling ribs are provided on the outside of the pump head (4) for forced-air cooling.

13. Conveyor device according to claim 4, wherein an intermediate cover (8) is arranged between the pump head (4) and a crankcase (5) of the feed pump(s) (2, 2'), which includes flow channels located between the delivery chamber (7) and the valves (11, 13), and the intermediate cover (8) is constructed as a plastic part.

14. Conveyor device according to claim 4, wherein the feed pump (2, 2') of the conveyor device (1, 100), that has the ventilation device (15) is constructed as one of a reciprocating piston pump or a membrane pump.

15. Conveyor device according to claim 4, wherein the conveyor device (1, 100) has a flow conduit with at least one pipe-shaped channel section (19), and the channel section (19) is connected essentially joint-free on a facing end to an adjacent partial area of the flow conduit using a sealing ring (21) made of an elastic material.

* * * * *

UNITED STATES PATENT AND TRADEMARK OFFICE

CERTIFICATE OF CORRECTION

PATENT NO. : 6,595,758 B1
DATED : October 8, 2003
INVENTOR(S) : Hauser et al.

It is certified that error appears in the above-identified patent and that said Letters Patent is hereby corrected as shown below:

Title page,
Item [22], PCT Filed:, please delete "Nov." and insert therefor -- Oct. --.

Signed and Sealed this

Thirtieth Day of December, 2003

JAMES E. ROGAN
*Director of the United States Patent and Trademark Office*